US006453836B1

(12) United States Patent
Ditmore

(10) Patent No.: US 6,453,836 B1
(45) Date of Patent: Sep. 24, 2002

(54) SAILBOAT KEEL WITH A ROTATABLE SECONDARY FOIL

(76) Inventor: Stephen Hampton Ditmore, 3902 Manhattan College Pkwy., Apt. 2B, Bronx, NY (US) 10471

( * ) Notice: Subject to any disclaimer, the term of this patent is extended or adjusted under 35 U.S.C. 154(b) by 0 days.

(21) Appl. No.: 09/717,482

(22) Filed: Nov. 21, 2000

Related U.S. Application Data

(60) Provisional application No. 60/167,666, filed on Nov. 29, 1999.

(51) Int. Cl.[7] ..... B63B 3/38
(52) U.S. Cl. ..... 114/140; 114/136
(58) Field of Search ..... 114/127, 132, 114/135, 136, 137, 140, 143

(56) References Cited

U.S. PATENT DOCUMENTS

| | | | | |
|---|---|---|---|---|
| 2,991,749 A | * | 7/1961 | Patterson | 114/132 |
| 3,324,815 A | | 6/1967 | Morales | |
| 4,089,286 A | | 5/1978 | Scheel | 114/140 |
| 4,352,335 A | | 10/1982 | Sugden | 114/143 |
| 4,377,124 A | | 3/1983 | Guigan | 114/128 |
| 4,686,922 A | | 8/1987 | Burroughs | 114/124 |
| 4,686,923 A | | 8/1987 | Greene | 114/140 |
| 4,703,708 A | | 11/1987 | Cohen | 114/141 |
| 4,970,974 A | | 11/1990 | Bielefeldt | 114/39.1 |
| 5,009,178 A | | 4/1991 | Geffken | 114/143 |
| 5,063,377 A | | 11/1991 | Smith | 340/764 |
| 5,076,186 A | | 12/1991 | Girard | 114/102 |
| 5,133,775 A | | 7/1992 | Chen | 623/27 |
| 5,152,238 A | | 10/1992 | Page | 114/143 |
| 5,280,760 A | | 1/1994 | Edwards | 114/39.1 |
| 5,533,462 A | | 7/1996 | Parsons | 114/140 |
| 5,622,130 A | | 4/1997 | Calderon et al. | 114/39.1 |
| 5,896,825 A | | 4/1999 | Trefethen | 114/39.28 |
| 5,967,074 A | | 10/1999 | Frantl et al. | 114/143 |
| 6,019,059 A | * | 2/2000 | Kelsey | 114/274 |

FOREIGN PATENT DOCUMENTS

| | | | |
|---|---|---|---|
| DE | 37 13 176 A1 | * | 8/1988 |
| WO | WO88/09286 | * | 12/1988 |
| WO | WO 99/03140 | | 1/1999 |

OTHER PUBLICATIONS

[Xerox Provided]TRAC Stabilizer Advert. Yachting Magazine, Nov. 2000 p. 144 American Bow Thruster.

* cited by examiner

*Primary Examiner*—Sherman Basinger

(57) ABSTRACT

A fin-type sailboat keel with a ballast bulb and a single winglet projecting from the after portion of the bulb is disclosed. The after portion of the bulb, to which the winglet is affixed, rotates, allowing the winglet to be canted about the centerline of the bulb 360 degrees. The winglet can have an adjustable angle of attack or a flap at its trailing edge, allowing various effects to be achieved. Mechanisms for the control of these moving parts are described. A fin stabilizer of similar geometry is also claimed.

5 Claims, 5 Drawing Sheets

SAILBOAT KEEL WITH A ROTATABLE SECONDARY FOIL

NOTE

This application claims the benefit of U.S. Provisional Application No. 60/167,666 filed Nov. 29, 1999. Disclosure Document No. 351253 filed Apr. 1, 1994 also pertained to this invention.

BACKGROUND OF THE INVENTION

1. Field of the Invention

The present invention relates to the enhancement of sailing vessel performance where shoal draft is required, and in general, and to ship anti-roll fins. Sailing vessel performance enhancement is accomplished by improving keel efficiency, by making the keel adjustable as wind and sea conditions change, and by providing for a high righting moment—with a low center of gravity and by providing for the generation of dynamic stability.

2. Prior Art

Presently, most shoal draft ballasted monohull sailing yachts that seek to improve on the efficiency of an ordinary low aspect ratio keel employ:

(a) a keel/centerboard combination, (b) a keel that widens at the tip (a version of which was patented by Henry Scheel, U.S. Pat. No. 4,089,286), or (c) a "winged" keel similar to that employed on the 1983 America's Cup Yacht AUSTRALIA II, and on other yachts subsequently. (A variation on this was patented by Leonard Greene, U.S. Pat. No. 4,686,923. Another variation, by Warwick Collins of England, uses tandem primary foils connected at their tips by a single quasi-delta shaped voluminous end plate. Some designers employ "wings" or "winglets" in combination with a ballast bulb at the tip of the keel.)

Solution (a) makes draft, aspect ratio, and lateral area variable, but the forward location of the lowered centerboard is less than optimum, and the cavity in the keel eliminates volume that could be used for ballast, and generates turbulence. Solution (b) lowers the center of gravity and may help to reduce tip vortices, but is only a marginal improvement over a more ordinary design. Solution (c) goes farther, but on either tack one of the winglets is doing most of the work while the other is along for the ride, creating unnecessary drag. The winglets are not adjustable, and therefore efficiency in deep water is less than optimum, and the winglets remain deployed and susceptible to damage in shallow areas.

In addition to these commonly employed shoal draft solutions, there are several patents that employ a hydrofoil at the bottom of a keel to achieve various effects. These include:

(d) U.S. Pat. No. 3,324,815 —Morales (e) U.S. Pat. No. 4,686,922 —Burroughs (f) U.S. Pat. No. 4,703,708 —Cohen (g) German Pat. No. DE 3713176 A1—Victora (h) PCT Pat. No. WO 88/09286 —Van Houdt The keels described in patents (d) and (e) are not hydrodynamically clean enough to achieve good overall lift/drag ratios. The solution employed in patent (f) is not conducive to shoal draft, and its two parts work against one another where opposing leeway is concerned when the lower foil is positioned to resist heel, causing the hull and upper foil to see a greater angle of attack than is optimal.

Patent (g) is broad, apparently encompassing several ideas. FIGS. 17–21 of that patent depict a pair of winglets that can be rotated about a longitudinal axis. The winglets are symmetrically opposed about that axis, and posts are shown inside the winglets for the purpose of individually adjusting their angle of incidence. The drawings do not appear specific as to the mechanism. In every orientation, these winglets would be vulnerable to damage from grounding or likely to snag mooring lines, lobster pot tethers, or other immersed objects. These observations apply equally to patent (h), the application of which to a sailing vessel that regularly heels is dubious.

Various patents seek to use a hydrofoil to lift the hull out of the water, in whole or in part. While this may benefit some sailing vessels at high speed, the likely result at lower speed is an increase in overall drag. Furthermore, unless the vertical force is generated to leeward of the vessel's center of gravity a loss of righting moment, and therefore an increase in heel and a decrease of projected sail area will result.

OBJECTS OF THE INVENTION

It is an object of this invention to provide an improved shoal draft keel for performance oriented monohull sailing yachts.

It is another object of this invention to provide a hydrodynamically clean design with low tip losses for a good overall lift/drag ratio while providing adjustability to suit a variety of sailing conditions.

It is yet another object of this invention to contribute to good static stability by having a low center of gravity, and (in the preferred embodiment) to generate righting moment dynamically when additional stability is required.

It is yet another object of this invention to provide for the protection of vulnerable parts when the vessel is entering or departing a harbor, negotiating a shoal, river, or canal, or in any situation in which a shoal draft configuration is desired, and to provide a design unlikely to sustain serious damage in a grounding regardles of its setting.

It is yet another object of this invention to provide an adjustable and effective fin stabilizer design for ships, submarines, motor yachts, and other motor vessels.

Additionally, it is an object of this invention to provide a mechanism for the adjustment of its movable parts which utilizes forces and geometry in an novel and elegant way (in the preferred embodiment).

SUMMARY OF THE INVENTION

The invention comprises a primary foil attached to the canoe body of a sailing vessel at the root, and to a ballast bulb of generally circular section at the tip. The after portion of the bulb comprises a rotatable hub from which a relatively high aspect secondary foil (or "winglet") protrudes. In the event this design is employed as a fin stabilizer on a motor yacht, or in any event, the bulb need not carry or constitute ballast, and may be no more than a protrusion from the trailing edge of the primary foil. In the preferred embodiment, the secondary foil has an adjustable flap on its trailing edge, as depicted in FIGS. 1 & 3. Alternatively, a one piece secondary foil of controllable or fixed angle of attack may be mounted. The hub is comprised of two parts, allowing the secondary foil to kick up should it strike a submerged object. Together, the hub and secondary foil can be rotated about an axis corresponding to the centerline of the bulb.

The secondary foil reduces the vortex about the ballast bulb which is caused by the primary foil, and the ability to reposition the secondary foil about the hub axis allows its setting to be optimized for each tack, windspeed, and heel angle. For short tacking in deep water, the secondary foil can be oriented down, away from the vessel's hull. On long tacks, the secondary foil can be adjusted to a true vertical position, compensating for the vessel's heel. Should the windspeed increase to where additional stability is required, the secondary foil can be repositioned to where it is approximately horizontal and to windward, and its effective angle of attack can be made negative using the adjustable flap, creating a downward force. [note: the last sentence and the following paragraph are not applicable to all alternate embodiments].

The motive force for rotating the secondary foil and hub can be achieved in a novel way. If the shaft controlling the flap on the secondary foil (or controlling the entire secondary foil's angle of attack in one alternate embodiment) is adjusted while the vessel is moving forward through the water with sufficient speed, and if the hub and secondary foil are able to rotate freely, the flap will act as a vane, with the miter gear to which it is attached seeking its original position on the rotated flap adjustment gear. The novelty lies in the fact that this action will stop when the secondary foil reaches a cant consistent with the rotation of the adjustment gear, the effect being that the secondary foil will "swim" to wherever the adjustment gear is set unless or until the rotation of the hub is locked.

1. Primary foil.
2. Ballast bulb.
3. Rotating hub.
4. Secondary foil.
5. Adjustable flap.
6. Access Plate.

Figure 1:
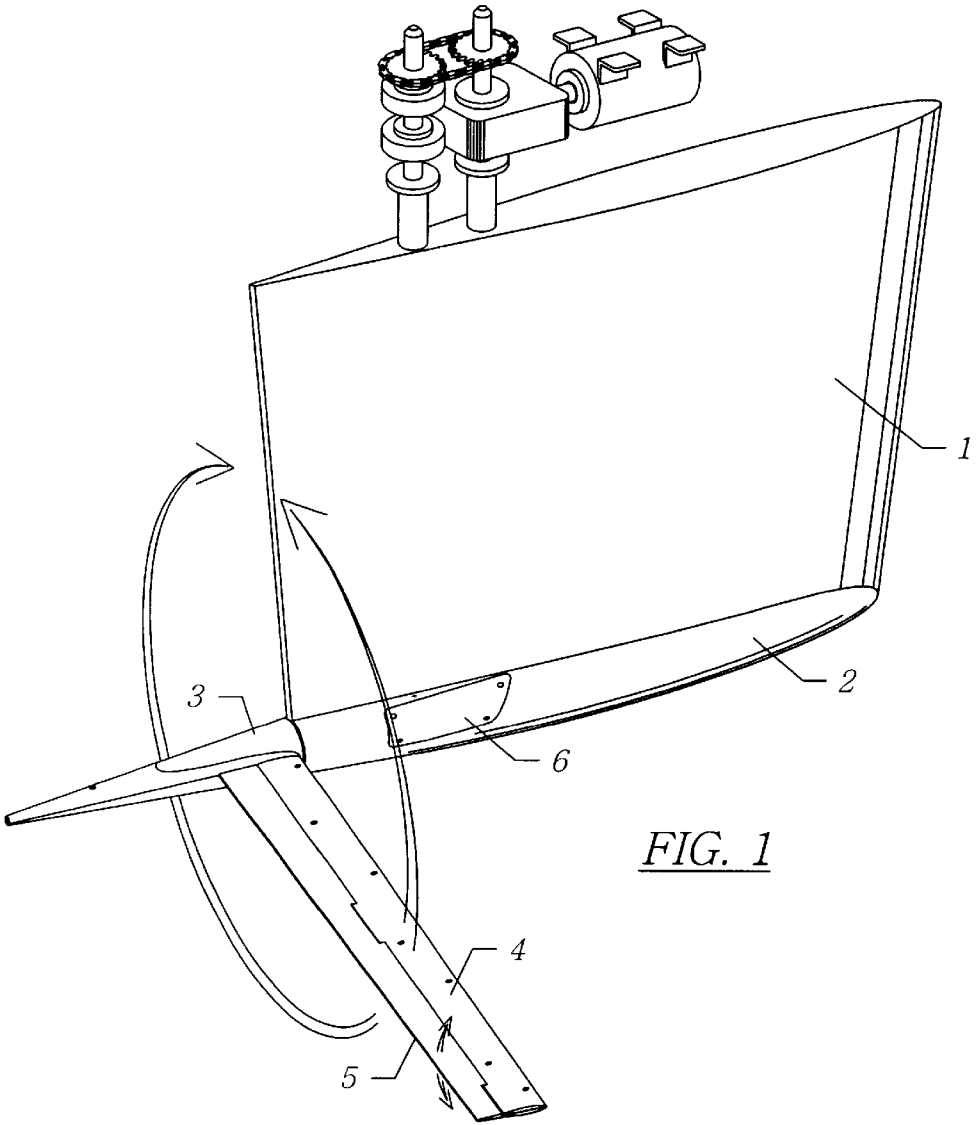
FIG. 1 is a perspective view of the keel (minus bolts/structure for attaching keel to hull).
Figure 2:
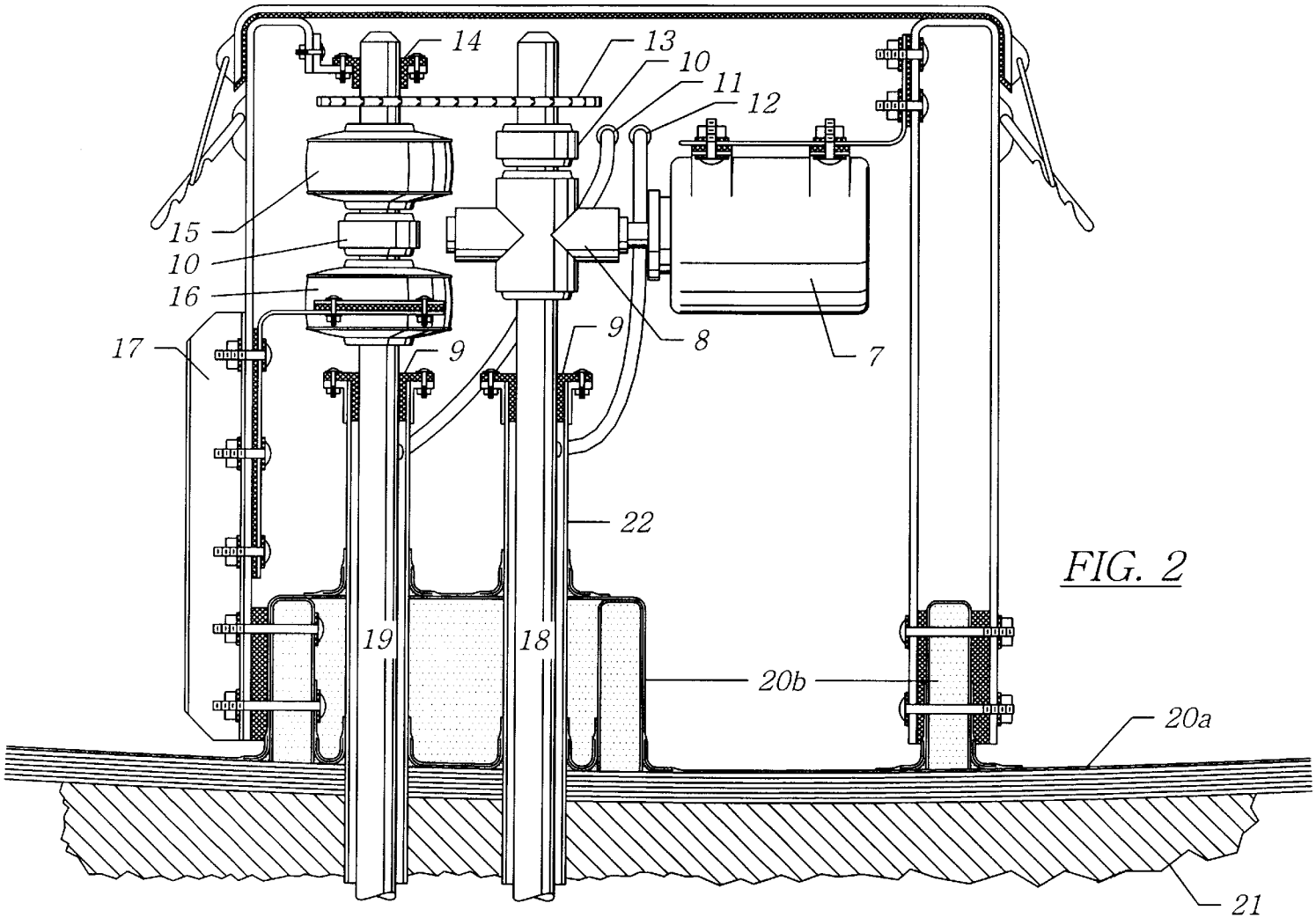

FIG. 2 is an elevation section showing the drive machinery inside the vessel's hull.

7. Drive motor—reversible—may be electric, hydraulic, pneumatic, or spring operated—has sufficient holding torque.
8. Right angle reduction gear in a housing. Employs a worm gear.
9. Bearing with seal.
10. Shaft rotation sensor linked to instrumentation (see #40, #41).
11. Vent tube (continues up through deck of boat to outside).
12. Lubricant tube (from gravity feed reservoir attached to underside of deck. Lubricant to be nontoxic and compatible with all plastics employed in areas to be lubricated. Vegetable oil is proposed.)
13. Chain and two sprockets (equal size) drive rotation shaft (#19).
14. Upper bearing supports rotation shaft.
15. Clutch. If electrical, "power off" type is preferred.
16. Brake. If electrical, "power off" type is preferred.
17. Structural support in way of brake mounting.
18. Trim shaft (adjusts flap, #5).
19. Rotation shaft. Rotates hub (#3), and with it secondary foil (#4) and other components.
20*a*. Existing boat—hull skin.
20*b*. Existing boat—transverse structural floors.
21. Primary foil. Tungsten or Lead Alloy casting.
22. Tube. Copper, bronze, nickel alloy, or stainless steel.

Figure 3:
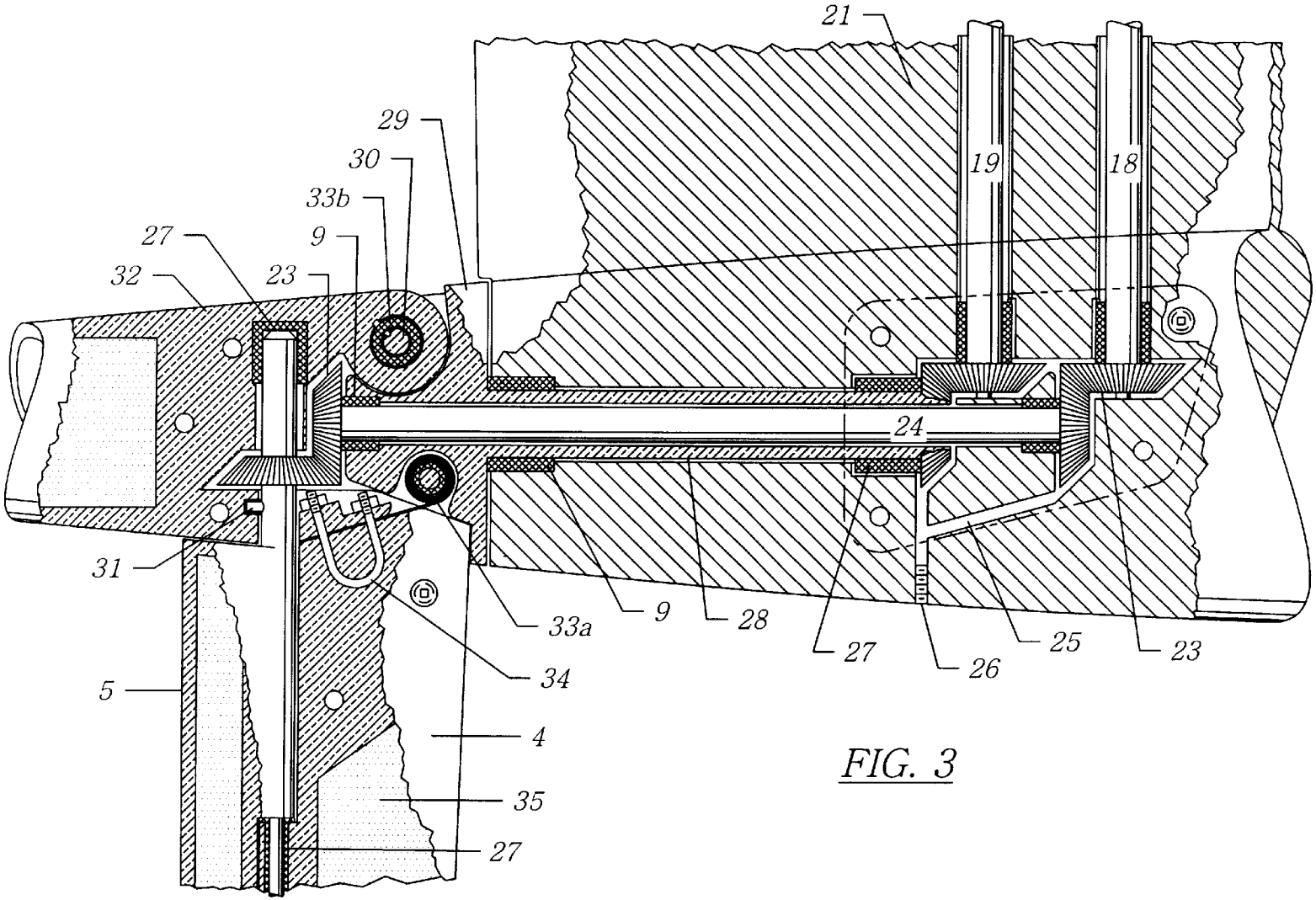

FIG. 3 is an elevation section showing the drive machinery inside the bulb and hub.

23. Miter gears, matched set.
24. Inner shaft (adjusts flap, #5).
25. Lubricant channel.
26. Lubricant drain w/plug.
27. Bearing. A tube made of UHMW plastic, nylon composite, Teflon, Delrin, Thordon, or other proprietary or non-proprietary substance with appropriate properties. Roller bearings, needle bearings, etc. may substitute where they will be immersed in lubricant. A bearing with a spherical outer surface may be employed where proper alignment is difficult to achieve.
28. Outer shaft. Part of casting #29. Rotates hub (#3).
29. Forward hub casting. Includes outer shaft (#28).
30. Kick-up pin.
31. Stud in groove. Limits rotation of the shaft that controls the adjustable flap (#5).
32. Aft hub casting—2 pieces.
33*a*. Neg'ator (Ametek Corp.) type spring—phosphor bronze.
33*b*. Torilastic (Goodrich Corp.) type torsion spring—rubber.
34. U-bolt cast into one half of aft hub casting (#32).
35. Foam filled cavity to reduce the moment induced by the weight of the secondary foil. Similar cavities elsewhere as shown.

Figure 4:
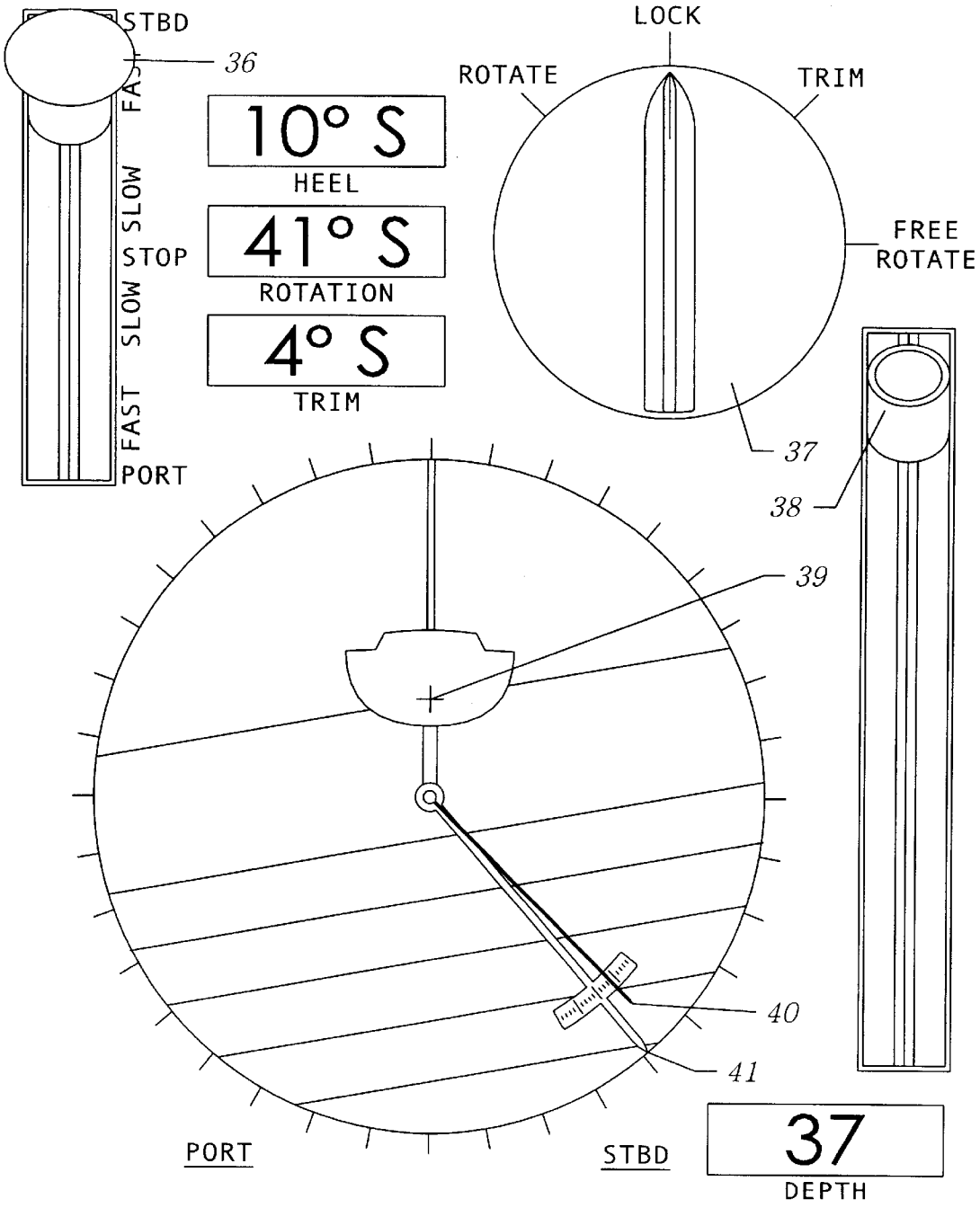

FIG. 4 depicts a possible control panel arrangement.

36. Motor control—controls reversible motor (#7).
37. Mode selector. Engages/disengages clutch and brake as follows:

| mode | clutch | brake |
|---|---|---|
| rotate | engaged | disengaged |
| lock | engaged | engaged |
| trim | disengaged | engaged |
| free rotate | disengaged | disengaged |

38. Handle receptacle for manual back-up pump or generator.
39. Pivot point for horizon card.
40. Trim indicator needle—linked to sensor (#10) on trim shaft (#18).
41. Rotation indicator needle—linked to sensor (#10) on rotation shaft (#19).

Figure 5:
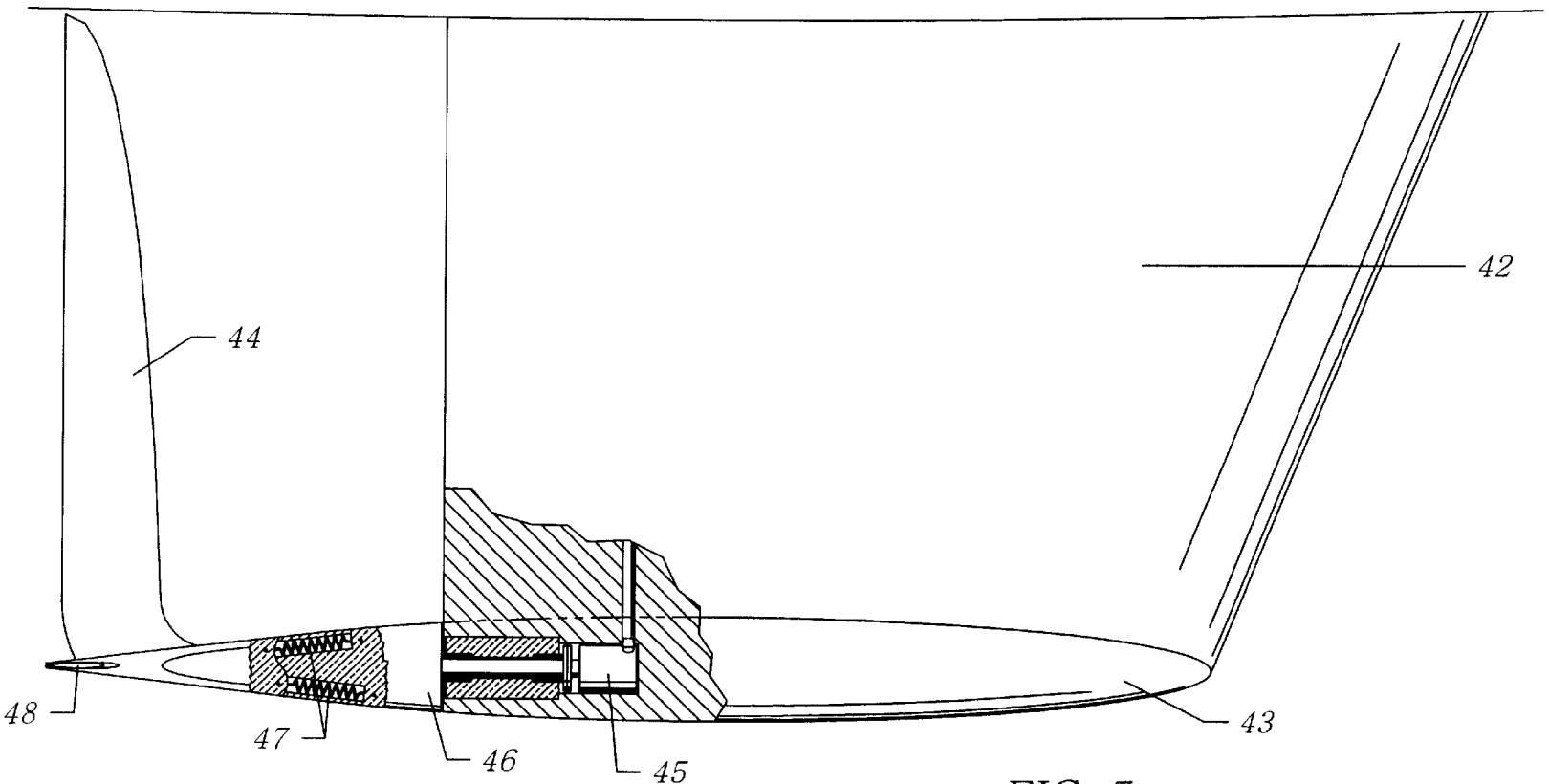

FIG. 5 is an elevation section of an alternate embodiment.

42. Primary foil.
43. Ballast bulb.
44. Secondary foil (dashed line shows same in "down" position).
45. Hydraulic motor with in-line planetary reduction gear—has sufficient holding torque or built-in pressure-off hydraulic brake or locking mechanism.
46. Rotating hub.
47. Tension springs.
48. Tertiary winglets (optional, approximately normal to secondary foil).

DESCRIPTION OF THE PREFERRED EMBODIMENT

The preferred embodiment is that shown in FIGS. 1–4, with the secondary foil being comprised of both a fixed and a movable portion in the fashion of a wing with a flap. This configuration allows the effective angle of attack of the secondary foil to be adjusted by adjusting the flap. The fixed portion supports bearings at a wider spacing than would be possible without it.

Alternate Embodiments/Notable Variations

A one piece secondary foil of controllable angle of attack may be substituted for the two piece secondary foil of the preferred embodiment. The control mechanism for such a foil would be the same as that shown for the flap (#5). The bearings required for such an arrangement are not diagrammed here, but it is noted that in the aircraft industry closely spaced bearings regularly support highly loaded high aspect ratio controllable pitch helicopter rotor and propeller blades.

A one piece secondary foil of fixed angle of attack [#44] may substituted for the two piece secondary foil of the preferred embodiment. Such a fixed secondary foil would not permit the generation of dynamic stability, but would offer many of the other advantages cited in this patent with less complexity. The secondary foil could be located farther aft than in the other embodiments, as there is no need for bearings and miter gears in the hub (see FIG. 5).

It is anticipated that the moving parts of this keel could be rotated using an hydraulic motor located in the bulb, rather than within the hull of the vessel, eliminating the rotation shaft (#19) and other components, especially where a one piece secondary foil of fixed angle of attack is employed.

It is also anticipated that the chain and two sprockets [#13] and the clutch [#15] could be eliminated and replaced by a gear atop each shaft, with space left between the two gears, and a gear that can be raised and lowered into this space, forming a simple transmission.

It is anticipated that a smaller pair of opposed fixed winglets [#48] could be incorporated onto the hub aft of the secondary foil in a plane perpendicular to that of said secondary foil. These would further cancel vortices, and, if mounted on the kick-up portion of the hub [#32], would assist the spring(s) [#33, #47] in returning the secondary foil to its position after hitting an object.

Finally, it is anticipated that this design could be employed as a fin stabilizer on a ship, motor yacht, or other vessel.

REFERENCES CITED

U.S. Patents
U.S. Pat. No. 6,019,059—Kelsey
U.S. Pat. No. 5,967,074—Frantl & Frantl
U.S. Pat. No. 5,896,825—Trefethen
U.S. Pat. No. 5,622,130—Calderon et. al.
U.S. Pat. No. 5,533,462—Parsons
U.S. Pat. No. 5,280,760—Edwards
U.S. Pat. No. 5,163,377—Calderon et. al.
U.S. Pat. No. 5,152,238—Page
U.S. Pat. No. 5,113,775—Imhoff
U.S. Pat. No. 5,076,186—Girard
U.S. Pat. No. 5,009,178—Geffken
U.S. Pat. No. 4,970,979—Bielefeldt
U.S. Pat. No. 4,703,708—Cohen
U.S. Pat. No. 4,686,923—Greene
U.S. Pat. No. 4,686,922—Burroughs
U.S. Pat. No. 4,377,124—Guigan
U.S. Pat. No. 4,352,335—Sugden
U.S. Pat. No. 4,089,286—Scheel
U.S. Pat. No. 3,324,815—Morales
U.S. Pat. No. 2,991,749—Patterson
PCT Pat.
WO 88/09286—Van Houdt
German Pat.
DE 3713176A1—Victora

I claim:

1. A pivoting winglet conjoined to a fin keel or stabilizing fin comprising:

(a) a winglet attached to the aft portion of a ballast bulb (b) the forward portion of said ballast bulb being affixed or integral to a fin keel at or near the tip of said fin keel (c) said aft portion of said ballast bulb being rotatable about a generally longitudinal axis so as to constitute a hub along with which said winglet can be pivoted about said axis (d) said winglet being singular, protruding from said aft portion of said ballast bulb in one direction only, there being no foil protruding from the opposite side of said aft portion of said ballast bulb.

2. A pivoting winglet conjoined to a fin keel or stabilizing fin as described in claim 1 wherein said winglet is designed to swing or otherwise give way without breaking should it hit an object.

3. A fin keel or stabilizer for attachment to the hull of a ship or boat comprising:

(a) a primary foil having an upper end adapted to be attached to said hull of a ship or boat (b) a protrusion from the trailing edge of said primary foil part or all of which can be pivoted about a generally longitudinal axis (c) a single secondary foil attached to said protrusion, extending from said protrusion in one direction only, there being no foil extending from said protrusion in the opposite direction (d) an adjustable flap along part of all of the trailing edge of said secondary foil.

4. A fin keel or stabilizer as described in claim 3 wherein said secondary foil can be made to utilize force from a fluid flow to move to a new rotational position established by a mechanism that controls said adjustable flap wherein the orientation of said adjustable flap automatically approaches longitudinal as said secondary foil approaches its new rotational position.

5. A fin keel or stabilizer for attachment to the hull of a ship or boat comprising:

(a) a primary foil having an upper end adapted to be attached to said hull of a ship or boat (b) a protrusion from the trailing edge of said primary foil part or all of which can be pivoted about a generally longitudinal axis (c) a single secondary foil attached to said protrusion, extending from said protrusion in one direction only, there being no foil extending from said protrusion in the opposite direction wherein means is provided for adjusting the angle of attack of said secondary foil wherein said secondary foil can be made to utilize force from a fluid flow to move to a new rotational position established by a mechanism that controls the angle of attack of said secondary foil wherein said angle of attack automatically approaches zero as said secondary foil approaches its new rotational position.

* * * * *